US009850064B2

(12) United States Patent
Egan et al.

(10) Patent No.: US 9,850,064 B2
(45) Date of Patent: Dec. 26, 2017

(54) WASTE RECEPTACLE HAVING SEALED REPLACEMENT LINER STORAGE

(76) Inventors: Charles Christopher Egan, Flemington, NJ (US); Lawrence DiRenzo, Stanhope, NJ (US)

( * ) Notice: Subject to any disclaimer, the term of this patent is extended or adjusted under 35 U.S.C. 154(b) by 780 days.

(21) Appl. No.: 13/533,748

(22) Filed: Jun. 26, 2012

(65) Prior Publication Data

US 2012/0267375 A1 Oct. 25, 2012

Related U.S. Application Data

(60) Provisional application No. 61/501,514, filed on Jun. 27, 2011.

(51) Int. Cl.
*B65D 90/04* (2006.01)
*B65F 1/06* (2006.01)

(52) U.S. Cl.
CPC ..... *B65F 1/062* (2013.01); *Y10T 29/49876* (2015.01)

(58) Field of Classification Search
CPC ..... B65F 1/04–1/06
USPC ..... 220/495.07, 501, 523, 495.06, 495.01, 220/62.21, 908.1, 526, 525, 505, 529, 220/908, 531
See application file for complete search history.

(56) References Cited

U.S. PATENT DOCUMENTS 3,300,082 A * 1/1967 Patterson ..... 220/495.07
3,451,453 A * 6/1969 Heck ..... 206/390
3,481,112 A * 12/1969 Bourgeois ..... 53/390
3,800,503 A * 4/1974 Maki ..... 53/390
4,096,966 A * 6/1978 Korshak ..... 220/603
4,319,694 A * 3/1982 Nehrbass et al. ..... 220/495.07
4,349,123 A * 9/1982 Yang ..... 220/495.07
4,364,490 A * 12/1982 Lang et al. ..... 220/495.07
4,721,226 A * 1/1988 Yurko ..... 220/495.07
4,798,363 A * 1/1989 Cortesi ..... 248/97
4,850,507 A * 7/1989 Lemongelli et al. .... 220/495.07
4,944,419 A * 7/1990 Chandler ..... 220/502
4,955,505 A * 9/1990 Battaglia ..... 220/495.07
5,031,793 A * 7/1991 Chen et al. ..... 220/495.07
5,115,935 A * 5/1992 Lemongelli ..... 220/495.07
5,295,607 A * 3/1994 Chang ..... 220/495.07
5,322,180 A * 6/1994 Ker ..... 220/495.07
5,328,028 A * 7/1994 Hale et al. ..... 206/366
(Continued)

*Primary Examiner* — Fenn C Mathew
(74) *Attorney, Agent, or Firm* — Global Intellectual Property Agency, LLC; Jordan Sworen

(57) ABSTRACT

Disclosed is a combined trash receptacle and replacement receptacle liner storage compartment. The receptacle comprises a structure having upstanding sidewalls forming an interior adapted to store refuse within a disposable liner. The base of the interior forms a divider shelf having a removable lid, whereby access to a lower cavity below the divider is provided. The cavity is an enclosed volume bounded by the upstanding receptacle sidewalls, interior divider and receptacle base surface, wherein the cavity provides a sealable storage compartment for storing replacement liners while separating the cavity from the interior portion of the receptacle. The replacement bags are thus shielded from fluid or solid refuse that may leak from a liner within the receptacle, while access into the cavity is granted via a divider access door. The divider may be formed from the receptacle sidewalls or is removably attachable thereto via a latching means around the divider periphery.

24 Claims, 5 Drawing Sheets

(56) References Cited

U.S. PATENT DOCUMENTS

| | | | | | |
|---|---|---|---|---|---|
| 5,372,272 | A * | 12/1994 | Jennings | 220/495.07 |
| 5,405,041 | A * | 4/1995 | Van Brackle | 220/495.07 |
| 5,458,259 | A * | 10/1995 | Falk | 221/22 |
| 5,503,292 | A * | 4/1996 | Cuccharia | 220/495.07 |
| 5,628,424 | A * | 5/1997 | Gola | 220/495.07 |
| 5,632,401 | A * | 5/1997 | Hurd | 220/495.07 |
| 5,638,957 | A * | 6/1997 | Brasier | 206/581 |
| 5,669,538 | A * | 9/1997 | Ward | 224/539 |
| 5,671,847 | A * | 9/1997 | Pedersen et al. | 206/554 |
| 5,678,723 | A * | 10/1997 | Swift et al. | 220/495.07 |
| 5,738,239 | A * | 4/1998 | Triglia | 220/495.07 |
| 5,881,900 | A * | 3/1999 | Meshorer | 220/495.07 |
| 6,126,031 | A * | 10/2000 | Reason | 220/495.07 |
| 6,234,339 | B1 * | 5/2001 | Thomas | 220/495.07 |
| 6,283,321 | B1 * | 9/2001 | Meshorer | 220/495.07 |
| 6,564,531 | B2 * | 5/2003 | Beck | 53/478 |
| 6,568,555 | B1 * | 5/2003 | LoCascio | 220/495.07 |
| D493,267 | S * | 7/2004 | Strobel et al. | D34/7 |
| 6,824,005 | B1 * | 11/2004 | Ashinhurst | 220/495.07 |
| 6,971,697 | B2 * | 12/2005 | Morales | 296/37.1 |
| 7,036,675 | B2 * | 5/2006 | Forest | 220/495.07 |
| 7,038,126 | B2 * | 5/2006 | Solet | 174/50 |
| 7,243,811 | B1 * | 7/2007 | Ramsey | 220/495.11 |
| 7,392,761 | B2 * | 7/2008 | Kujawa et al. | 119/61.5 |
| 7,395,990 | B1 * | 7/2008 | Stevens | 248/97 |
| 8,061,546 | B2 * | 11/2011 | Ramsey | 220/495.11 |
| 8,104,657 | B2 * | 1/2012 | Barella | 225/39 |
| 8,215,089 | B2 * | 7/2012 | Stravitz | 53/567 |
| 8,317,055 | B2 * | 11/2012 | Zawrotny et al. | 220/495.07 |
| 8,556,108 | B2 * | 10/2013 | Farone et al. | 220/529 |
| 2003/0102316 | A1 * | 6/2003 | Forest | 220/495.07 |
| 2003/0121922 | A1 * | 7/2003 | Lawrence | 220/495.07 |
| 2005/0082294 | A1 * | 4/2005 | Ceschi | 220/495.07 |
| 2005/0092753 | A1 * | 5/2005 | Best | 220/495.07 |
| 2005/0199633 | A1 * | 9/2005 | Stanley | 220/495.07 |
| 2005/0258177 | A1 * | 11/2005 | Woodson | 220/495.07 |
| 2006/0138149 | A1 * | 6/2006 | Tracy | 220/495.07 |
| 2006/0169697 | A1 * | 8/2006 | Koch | 220/495.07 |
| 2006/0191941 | A1 * | 8/2006 | Barrett | 220/495.07 |
| 2006/0191942 | A1 * | 8/2006 | Collis | 220/495.07 |
| 2006/0226153 | A1 * | 10/2006 | Licata | 220/495.07 |
| 2006/0261072 | A1 * | 11/2006 | Diep | 220/495.07 |
| 2007/0006871 | A1 * | 1/2007 | Strachan | 126/263.09 |
| 2007/0080092 | A1 * | 4/2007 | DeLuca | 206/554 |
| 2007/0215622 | A1 * | 9/2007 | Perez | 220/495.07 |
| 2008/0000911 | A1 * | 1/2008 | Bailey | 220/495.07 |
| 2008/0083757 | A1 * | 4/2008 | Parker et al. | 220/495.07 |
| 2009/0236345 | A1 * | 9/2009 | Mack-Robles et al. | 220/495.07 |
| 2009/0261104 | A1 * | 10/2009 | Cho | 220/495.07 |
| 2010/0206880 | A1 * | 8/2010 | Leon | 220/495.07 |
| 2010/0276428 | A1 * | 11/2010 | Lord et al. | 220/495.07 |
| 2011/0011871 | A1 * | 1/2011 | Licata | 220/495.07 |
| 2011/0284549 | A1 * | 11/2011 | James et al. | 220/495.07 |
| 2012/0080435 | A1 * | 4/2012 | Carmosino | 220/495.07 |
| 2012/0145718 | A1 * | 6/2012 | Quarry et al. | 220/507 |
| 2012/0261423 | A1 * | 10/2012 | Zawrotny et al. | 220/495.07 |
| 2013/0341328 | A1 * | 12/2013 | Schneider et al. | 220/259.2 |

* cited by examiner

WASTE RECEPTACLE HAVING SEALED REPLACEMENT LINER STORAGE

CROSS REFERENCE TO RELATED APPLICATION

This application claims the benefit of U.S. Provisional Application No. 61/501,514 filed on Jun. 27, 2011, entitled "Convenience Trash Can." The patent application identified above is incorporated here by reference in its entirety to provide continuity of disclosure.

BACKGROUND OF THE INVENTION

Field of the Invention

The present invention relates to trash cans and refuse containers. More specifically, the present invention pertains to a refuse container that is adapted to securely house and shield replacement receptacle liners. The structure of the present invention is one preferably of detachable components, or alternatively may be a unitary structure. Storage of the replacement liners is completely shrouded from the interior of the receptacle thereabove.

Common trash receptacles and containers employ a structure that includes upstanding sidewalls that form an open interior to house trash, refuse or recycling material that is collected over a period of time. Generally these receptacles are lined with disposable liners or bags, which shroud the interior surfaces of the receptacle from the refuse and prevent dirt, grime and other contaminates from contacting the interior of the receptacle walls. This improves overall cleanliness of the receptacle and reduces the need to continually clean the device after each filling, as solid and fluid refuse is largely contained within the liner to create a physical barrier that keeps the container interior cleanly. However, it is not uncommon for such liner bags to tear, burst or otherwise leak while in operation. This is common during periods when the liner is overfilled, when liners of poor quality or structural integrity are utilized, or during the withdrawal of the liner from the receptacle. During liner removal, snagging of the liner, load placed on the liner bag from the user placing upward tension on the bag, and finally the traction along bag exterior created by the receptacle sidewalls introduces a risk of tearing or rupture of the liner walls.

The latter occurrence is one where the receptacle interior may be exposed to solid and liquid refuse leaking from a compromised liner bag. This often results in contamination of the receptacle interior, and further to exposure of replacement liners that may be kept beneath the liner being removed. It is common to keep several unused and replacement liners beneath a deployed liner, wherein the replacement is readily accessible once the first liner is filled and subsequently replaced. Further still, receptacle devices having been developed that include a lower cavity specifically for storing receptacle replacement rolls or liner boxes therein for this purpose. However, it is submitted that during extraction of the liner and in the event of a ruptured liner, these replacement liners and cavities are exposed to the refuse being removed. Most receptacles having a lower interior cavity form an open aperture for accessing a roll or folded set of liner replacements, which provides little to no shielding of the replacement liners, particularly if liquid waste leaks from the liner being removed.

The present invention is therefore submitted to address the clear need for a receptacle having a means of storing replacement liners therein, while further providing a means of separation between the liner cavity and the receptacle cavity being lined. Thus, a secure boundary is established that prevents unused liners from being compromised by trash being removed and discarded, particularly in the event of a liner failure. No uncovered through-holes or open penetrations are provided along the boundary, but rather a removable access panel is provided that creates a sealed closure of the lower cavity and a ready means of access to replacement liners stored within a liner box or deployable roll thereof within the cavity and beneath the receptacle interior.

Description of the Prior Art

Devices have been disclosed in the prior art that relate to trash receptacles. These include devices that have been patented and published in patent application publications. These devices generally relate to receptacles that include a lower storage cavity for replacement liners, while further providing a means of accessing the liners via an aperture that does not prevent liquid or solid waste from crossing its boundary. The forgoing are list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,115,935 to Lemongelli discloses a disposable bag box that permits the easy engagement and release of bags from a cavity along the base of a trash receptacle. The trash receptacle is adapted to be lined with a disposable trash bag that extends from a bag containing box housed within an enclosure along the base of the receptacle, wherein bags are easily pulled therefrom and separated to line the receptacle interior and trapping discarded debris. The enclosure of the receptacle forms a tapering cavity to wedgably receive the bag box therein. The bag box further includes two parallel slots for positioning a communicating a disposable bag therethrough and from the bag box within the receptacle enclosure. The act of removing a bag full of refuse from the receptacle automatically pulls the next, attached bag upwardly from the bag box for replacement within the receptacle. The Lemongelli device, while disclosing a receptacle particularly suited for a bag box and a continuous roll of disposable bags, does not shield the bag box from refuse that may leak from a torn or burst bag. The present invention provides a barrier between the replacement bags and the receptacle interior to prevent contamination of unused bags in this scenario.

Another such device is U.S. Pat. No. 4,850,507 also to Lemongelli, which discloses a trash receptacle adapted to be lined by disposable bags that are fed one at a time from a box of folded bags held within a bag box-receiving cavity. The upstanding portions of the cavity include inward tabs that secure the bag box within the cavity and prevent the box from freely exiting the cavity. Embodiments of the receptacle include a cavity having a downwardly facing opening or alternatively upwardly facing openings for loading the bag box into the cavity. Once inserted, bag liners are removed from the bag box to line the receptacle open portion above the lower cavity. Similar to the '935 Lemongelli device, the '507 device provides no physical barrier between the bag box and the open portion of the receptacle adapted to be lined with the liner bags.

In a similar manner as the Lemongelli devices, U.S. Pat. No. 4,349,123 to Yang discloses a garbage can having a packaged and folded plastic bag supplier, wherein the plastic bags are folded and interconnected with each other within a box along the base of the can for supplying a continuous stream of bags therefrom. A base supports the package box of folded bags while feeding bags through a slot along its upper plate surface. The upper plate surface forms the base of the garbage can when installed therein, while the box of bags is supported using a pair of L-shaped legs extending downwardly from the upper plate. Lacking from the Yan design is a means to conceal the unused bags from the receptacle or garbage can interior portion, which exposes the unused bags to refuse and liquid prior to their use.

U.S. Pat. No. 4,721,226 to Yurko describes a waste container structure to receive a garbage bag dispenser box through a side opening along the base of the container. The waste container comprises an open interior with upstanding sidewalls, along with an enlarged sidewall slot for sliding a rectangular garbage bag box thereinto. The bag dispenser box is prevented from being lifted upwards while advancing a new bag therefrom by inwardly extending projections provided along the inside wall of the container. The container is preferably rectangular for accepting a garbage bag box; however a circular embodiment is disclosed having openings opposite of the side opening to accept the corner regions of the bag box therethrough and center the bag distribution opening along the top of the box within the container. The Yurko device provides a side access door with only tabs separating the bag box with the rest of the receptacle, which is a consistent failing that similarly fails to shroud the unused bag from refuse and liquid within the receptacle.

Further, U.S. Pat. No. 5,458,259 to Falk discloses a trash receptacle and a magazine attachable to the base of the receptacle for housing and dispensing disposable receptacle liner bags into the receptacle through an aperture in the base of the receptacle. An upwardly open base of the magazine is adapted to accept the base of the trash receptacle, which connects via a hinge thereto to allow one to reach into the receptacle without separating the magazine from the receptacle. Receptacle liner bags are stored within a box positioned within the cavity of the magazine and fed through the base of the receptacle, wherein the two are removably attached to one another to form separate structures secured as one assembly. While providing a means of inserting and lining the interior of a receptacle, the Falk device requires two separable components: a receptacle with a specific aperture in its base, and an accompanying and corresponding magazine adapted to accept the receptacle and feed liners through the aperture along its base. The present invention differs in structure and operation, wherein a removable divider forming the enclosure cavity within the receptacle base is described. The cavity of the present invention is sealable from the interior of the receptacle via a lid, preventing cross contamination between the two cavities.

Similar in style to the aforementioned receptacle devices, U.S. Pat. No. 4,798,363 to Cortesi provides a waste basket having a roll of liner bags within its lower section, whereby the roll of liners is fed through a slot in the base of the waste basket for successive replacement bags as a first bag is withdrawn from the basket and discarded. The device comprises a lower cavity and a separating wall, wherein the wall forms the base of the waste basket and provides an aperture for feeding the continuous roll of liners therethrough. Similar to the aforementioned drawbacks, the Cortesi device provides no barrier that would block liquid or solid refuse from entering into the aperture and contaminating the unused liner bags.

Finally, and of similar design as the Cortesi device are U.S. Pat. No. 3,800,503 to Maki, U.S. Pat. No. 4,364,490 to Lang and Published U.S. Patent Application Publication No. 2006/0191941 to Barrett. These devices also disclose trash cans or waste receptacles forming a lower enclosure having an aperture to readily withdraw a replacement liner therethrough as a first liner is removed and discarded. The roll of liners is connected along a line of perforated connection, whereby the first bag is removed while simultaneously withdrawing another through the aperture in the base. None of these or the aforementioned devices provides a physical barrier or means to separate the interior of the waste receptacle with the lower cavity forming a housing for a roll of replacement liners or receptacle bags.

The present invention provides a new trash receptacle structure having a formed interior cavity that is divided and sealed off from the receptacle interior, providing a means of physical separation between utilized and filled liner bags with replacement bags stored within the cavity thereunder. The receptacle is preferably formed of a removable interior divider shelf, wherein the interior divider affixes to the receptacle sidewalls and the cavity formed below the divider is accessible via a removable lid. Alternatively a receptacle having an interior divider shelf may be designed of unitary construction for loading and accessing liners within the lower cavity. Overall, it is submitted that the present invention address a clear need in the art for separated storage of replacement liners within a trash receptacle interior. The structure and intent of the present invention substantially diverge in design elements from the prior art, and consequently it is clear that there is a need in the art for an improvement to existing trash receptacle devices. In this regard the instant invention substantially fulfills these needs.

SUMMARY OF THE INVENTION

In view of the foregoing disadvantages inherent in the known types of trash receptacles now present in the prior art, the present invention provides a new trash receptacle and divided storage cavity wherein the same can be utilized for providing convenience for the user when storing replacement liners within a sealed cavity provided within the interior of a trash receptacle.

It is therefore an object of the present invention to provide a new and improved trash receptacle device that has all of the advantages of the prior art and none of the disadvantages.

It is another object of the present invention to provide a trash receptacle device that offers an interior cavity within the receptacle for storing replacement liner bags, wherein the cavity is accessible for withdrawing replacement bags therefrom.

Another object of the present invention is to provide a trash receptacle device that creates a sealed boundary between its interior cavity and the interior of the receptacle, thereby shielding replacement liners and the lower cavity from any liquid or solid refuse within the receptacle interior.

Yet another object of the present invention is to provide a trash receptacle device that is preferably constructed using three primary components: a receptacle, a divider shelf attachable to the interior receptacle sidewalls for establishing the lower cavity portion, and finally an accessible lid that covers an aperture through the shelf that provides access to the lower cavity.

A final object of the present invention is to provide a trash receptacle adapted to store a liner bag box or roll of replacement liners within its interior cavity, wherein access for the box or roll is provided through the divider wall lid.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
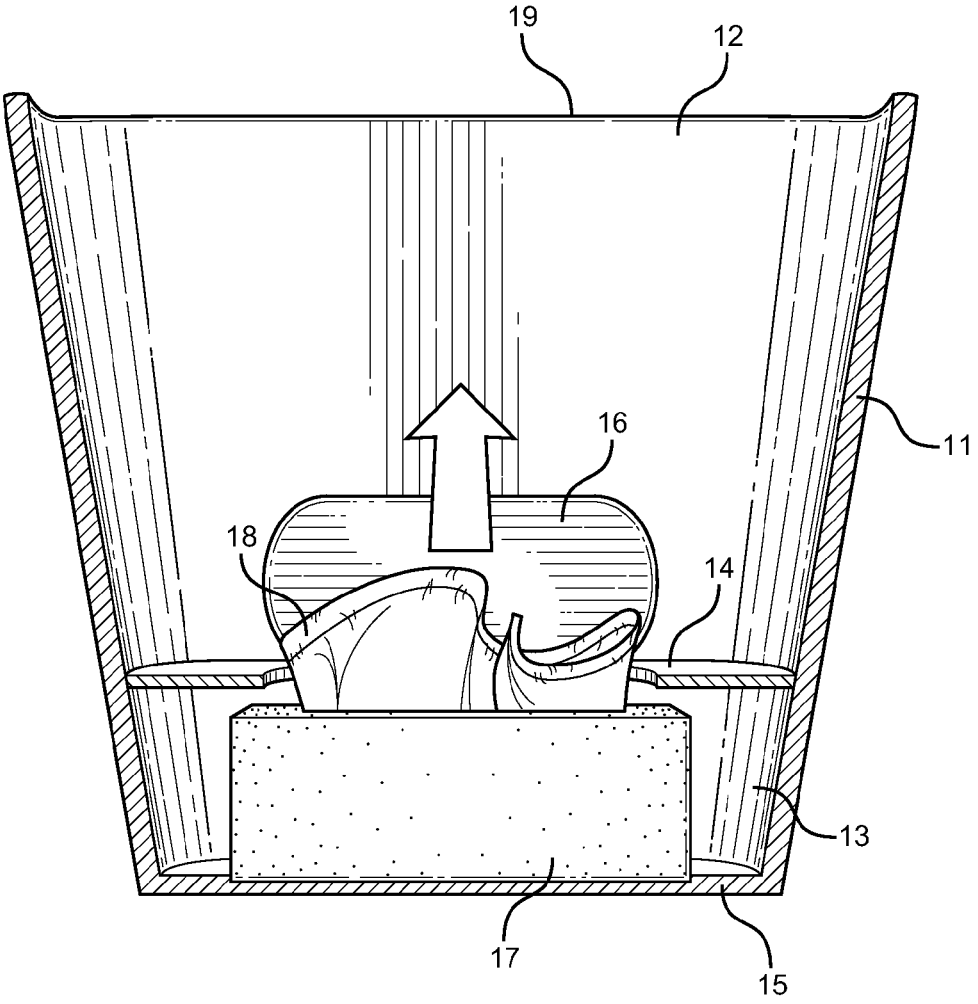
FIG. 1 shows a cross section view of an embodiment of the present invention wherein a unitary structure is provided.

Reference is made herein to the attached drawings. Like reference numerals are used throughout the drawings to depict like or similar elements of the trash receptacle. For the purposes of presenting a brief and clear description of the present invention, the preferred embodiment will be discussed as used for storing refuse and providing a sealed cavity for replacement receptacle liners. The figures are intended for representative purposes only and should not be considered to be limiting in any respect.

Referring now to FIG. 1, there is shown a cross sectional side view of an embodiment of the present invention, wherein the structure of the receptacle is one of unitary or molded construction. The device comprises a waste receptacle having upstanding sidewalls 11 forming an interior volume 12 and enclosed along its lower portion by a base 15 adapted to rest against a supporting surface. The upper portion of the receptacle terminates at an upper ledge 19 that may be open to provide ready access to the receptacle interior volume 12, or alternatively provide a lid closure mechanism thereover. Within the interior 12 of the receptacle and along the lower portion thereof is an open cavity 13 formed by a divider wall 14 that protrudes inwardly from the upstanding sidewalls of the receptacle and bounded along its sides and base by the sidewalls 11 and receptacle base 15, respectively. The interior cavity 13 is a sealed enclosure adapted to house replacement receptacle liners 18 or bags, which are preferably accessed via a hingeable or removable lid structure 16 that breaks the boundary between the receptacle upper interior portion 12 from the cavity interior 13.

The cavity 13 is adapted to house a roll of connected liners, loose liner bags or further a liner bag box 17 that stores the liners therein and are consecutively removed for deployment within the receptacle interior 12. The divider wall 14 provides a sealed boundary between the cavity 13 and the receptacle interior 12 such that liquid and solid refuse is prohibited from entering the cavity, whereby unused liners 18 may otherwise be contaminated prior to their use. The lid 16 access is one that creates a watertight seal that prevents any cross contamination, thus shrouding the unused bags in the event of a filled liner rupture or the introduction of spilled trash within the receptacle interior.

Figure 2:
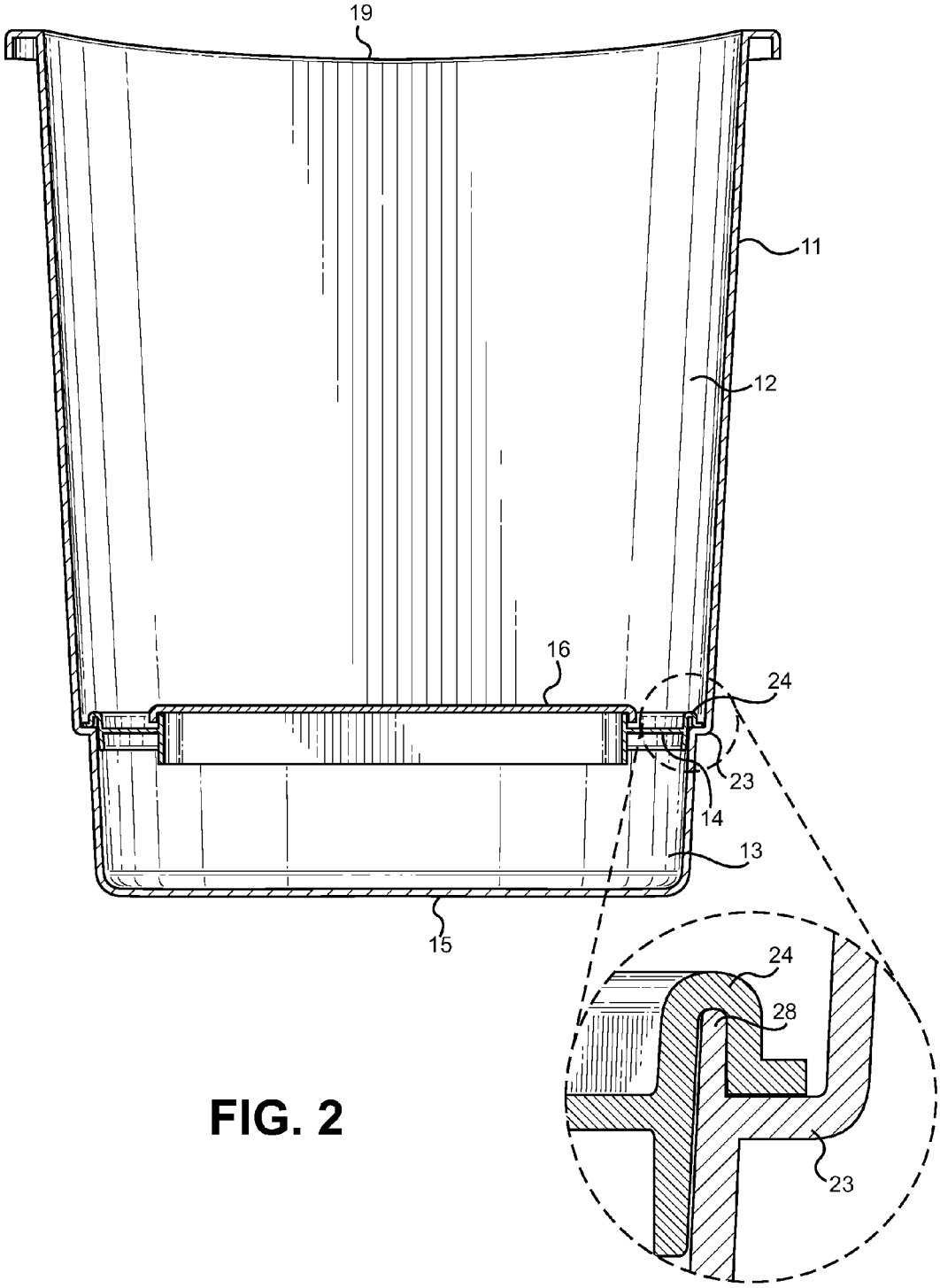
FIG. 2 shows a cross section view of the preferred embodiment of the present invention.
Figure 3:
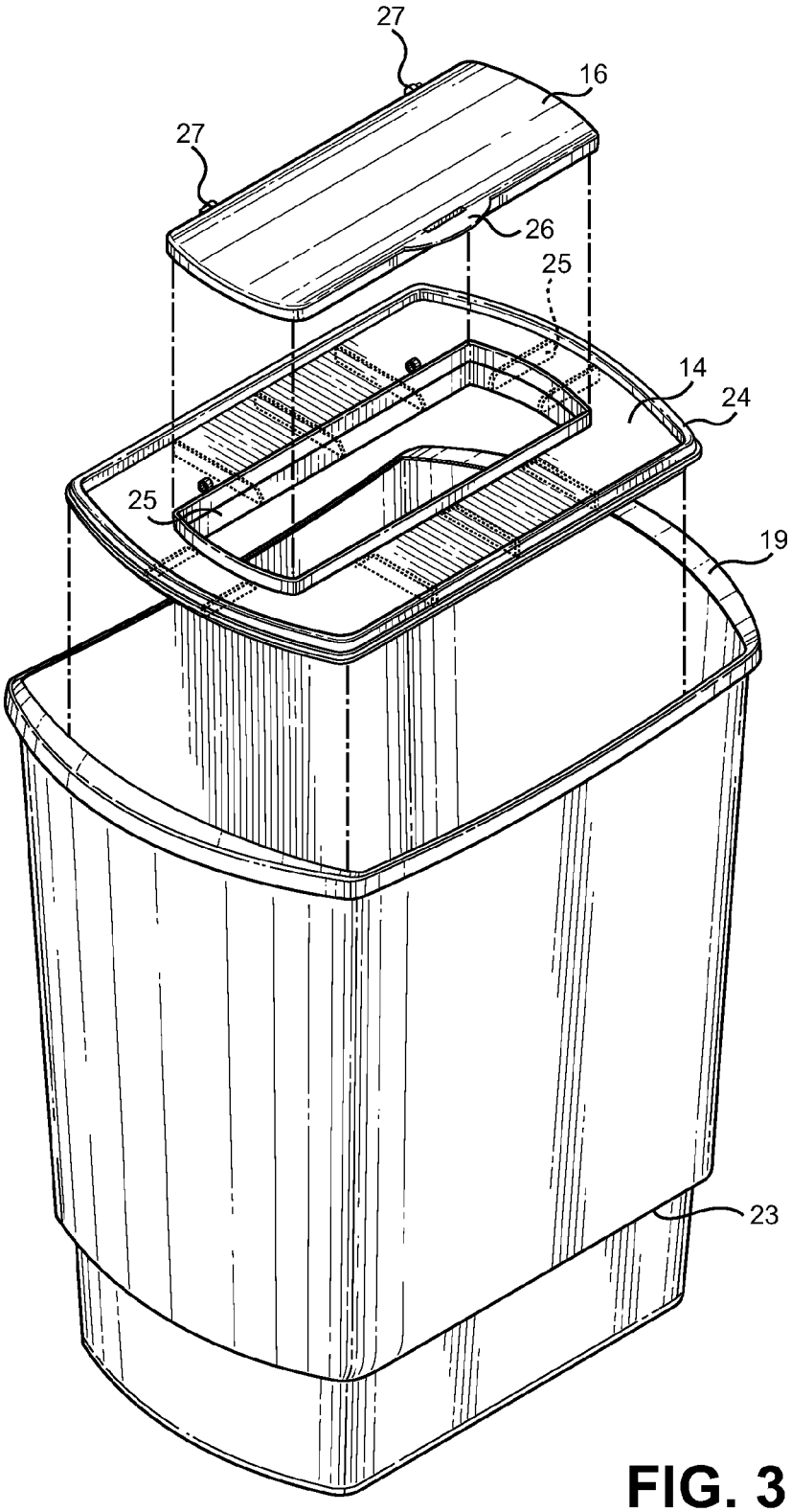
FIG. 3 shows an exploded perspective view of the preferred embodiment of the present invention.

Referring now to FIGS. 2 and 3, there is shown a cross section view and exploded perspective view of the preferred embodiment of the present invention, wherein the receptacle comprises upstanding sidewalls 11 forming an upper interior volume 12, and a lower cavity 13 formed below a secured divider wall 14. In this embodiment, the divider wall 14 is a separate structure that is secured into place along an internal ledge 23 within the receptacle interior using snap engagement of the divider peripheral edge 24. The divider edge 24 comprises a curved lip that snaps over an upstanding portion 28 of the receptacle internal ledge 23 for securement, while a line of adhesive along the ledge 23 may further be utilized to permanently secure the two assemblies together during construction. The divider itself is a reinforced panel having a central aperture covered by a hingeable lid 16. The free field portions of the divider panel are reinforced from below using ribs 25 or similar support lattice members, which reinforce the panel and prevent deflection or buckling thereof under load from a filled liner bag within the receptacle interior 12. This embodiment provides a structure that is more readily manufactured than that of the unitary structure; however both embodiments comprise the same base features: a receptacle interior, a divider wall and an enclosed interior cavity that is shrouded from liquid and solid refuse during use. The receptacle walls 11 of the preferred embodiment include a step 23 inward that creates an interior ledge upon which the snapping securement of the divider wall 14 is positioned. The lid 16 of the divider 14 further comprises a hingeable connection 27 and a lift tab 26 for unseating the lid when accessing the interior liner cavity 13.

Figure 4:
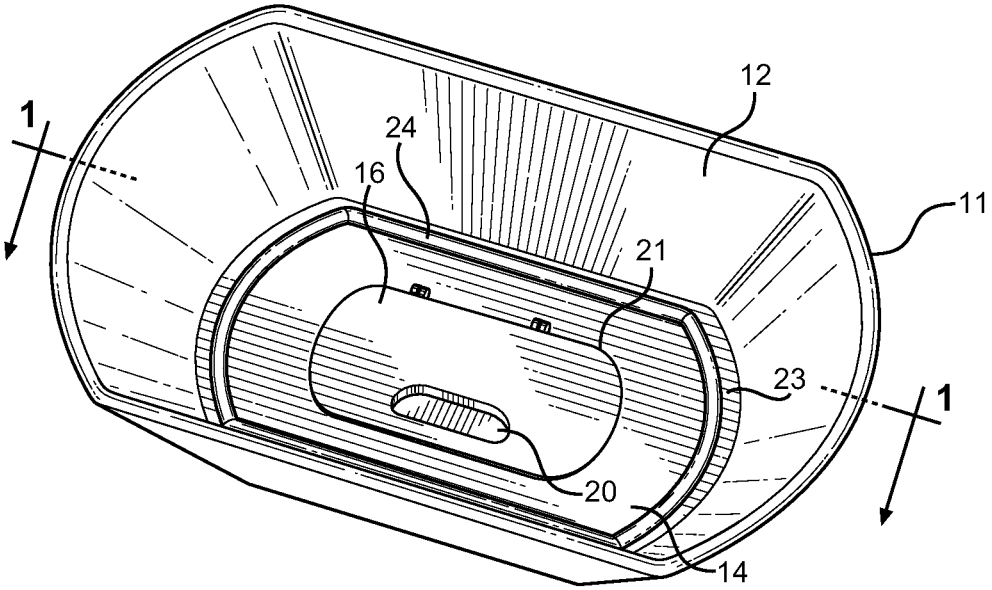
FIG. 4 shows an overhead view of the preferred embodiment of the present invention

Referring now to FIG. 4, there is shown an overhead perspective view of the present invention, wherein the receptacle interior volume 12 and the secured divider wall 14 are visualized. The receptacle forms an interior volume 12 by providing upstanding and surrounding sidewalls 11, which form a region within which a liner may be placed and refuse may be stored until the volume 12 is filled and the liner is in need of replacement. A lower interior cavity is formed from an interior divider wall 14 snap engagement and adhesive bonding along the internal ledge 23, wherein the cavity includes an open space to store replacement liners and structures in support thereof. Access to the cavity is provided via a securable lid 16, which seals and separates the receptacle interior 12 from the cavity interior and further provides an access port thereinto. The lid 16 may include a pull tab or recessed finger grip 20 within which to pry the lid 16 open or rotate it about its hinged connection with the divider wall 14. In a further embodiment, an outer access panel 22 along the exterior of the receptacle and adjacent to the interior cavity is provided for greater access to the interior cavity. This access panel 22 is a hingeable structure that opens the sidewall of the receptacle and provides access to the interior cavity for placement of liner bag boxes. The exterior access panel 22 is particularly suited for entering larger liner containers into the cavity, wherein the boundary 21 of the interior lid 16 does not otherwise provide ready access for larger assemblies.

Figure 5:
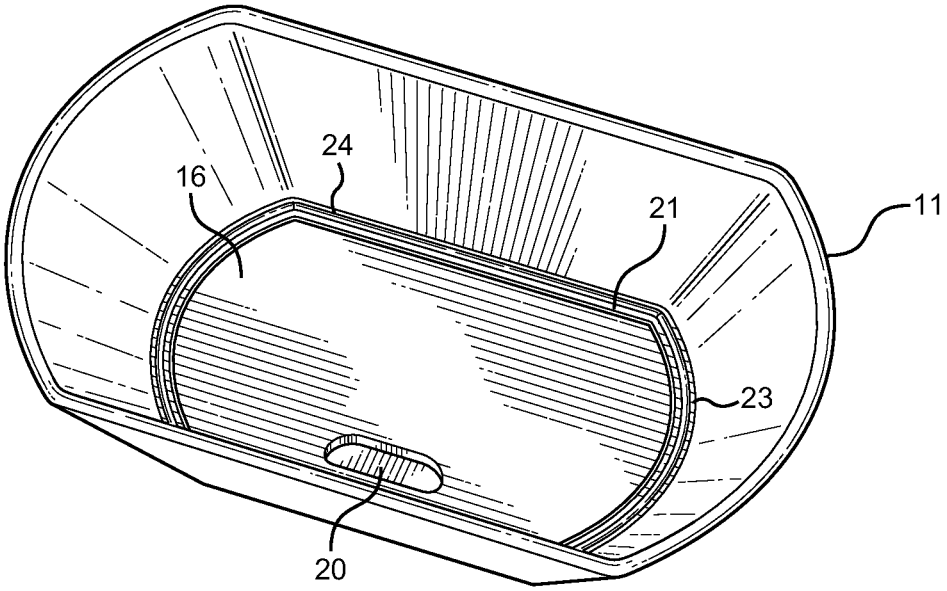
FIG. 5 shows an overhead view of another embodiment of the present invention, wherein an enlarged interior lid is provided.

Referring now to FIG. 5, there is shown an embodiment of the present device that comprises an enlarged divider wall lid 16, which provides greater access 21 to the cavity therebelow and allows the user to place larger liners or larger liner boxes into the cavity and through the interior lid 16. This embodiment eliminates the need for a side access panel, as the enlarged interior lid 16 provides sufficient clearance 21 for placement of larger liner boxes. The side panel is thus a redundant feature that may be eliminated for simplicity of design in this embodiment.

In either embodiment, the receptacle sidewalls, base and interior divider walls are preferably formed of two primary structures: the receptacle structure and the snap-on divider wall. The lid and access door may be hinged or otherwise secured thereto, while the interior lid forms a liquid and discrete object barrier between the cavity and receptacle interior to prevent cross contamination. This interior barrier prevents unused liners from being compromised or contaminated by collected refuse in the receptacle, while the interior cavity further provides a convenient storage location for replacement liners. The device is designed to centralize the location of all necessary replacement liners and improve overall efficiency when changing liners, while at the same time shielding the replacement liners from the trash being removed or stored in the receptacle. When replacing old garbage liners and bags, users simply lift out and dispose of filled liner, open the divider wall lid and retrieve a fresh replacement, whereafter the lid is secured to seal the lower cavity and the fresh liner is secured to the rim of the receptacle sidewalls. It is desired to aide users in conserving kitchen storage space, while also preventing unused bags from being ruined prior to their use.

Figure 6:
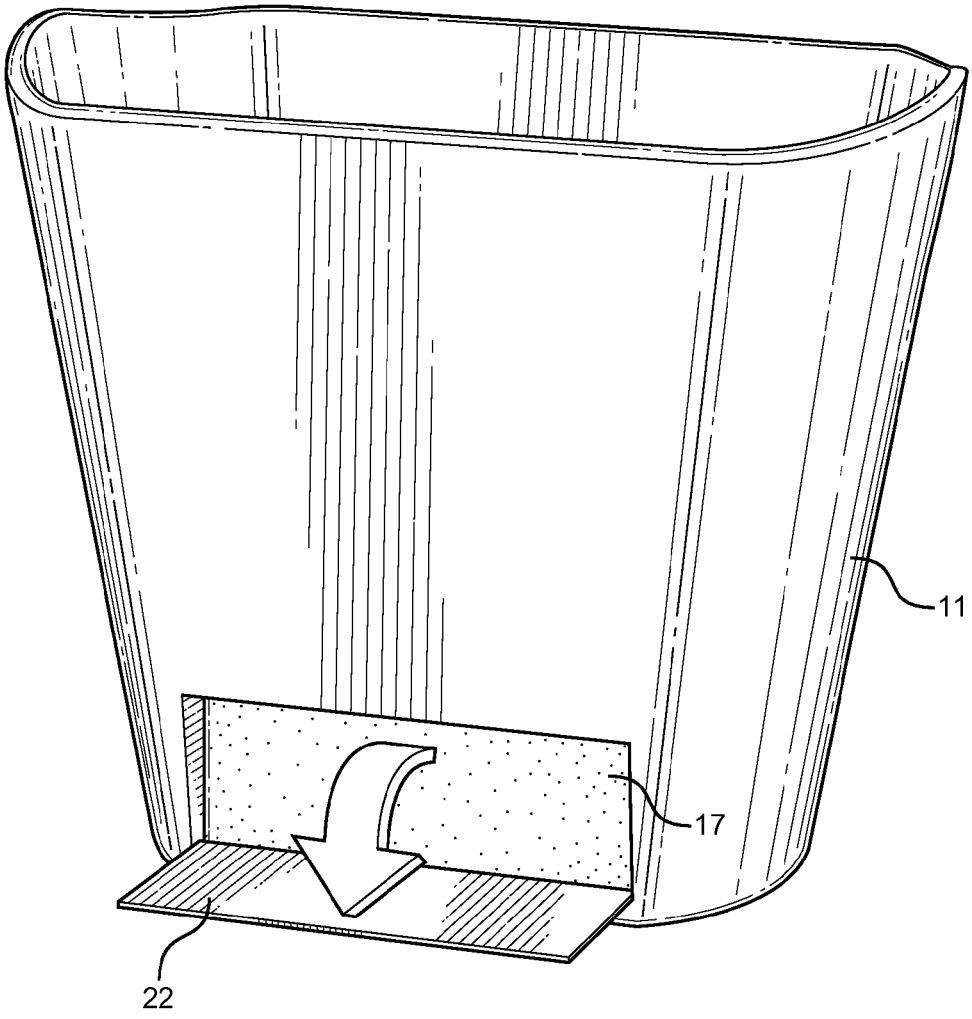
FIG. 6 shows a side perspective view of an alternate embodiment of the present invention, wherein a side access panel is provided.

Referring now to FIG. 6, there is shown a perspective side view of the present invention, wherein this embodiment comprises a side panel access door 22 for improved access to the interior cavity within the receptacle. A larger access port into the interior cavity below the interior divider wall is provided through the sidewall 11 of the receptacle, wherein the door 22 is hinged or removable from the receptacle sidewalls for inserting replacement liner boxes 17 thereinto, whereafter the divider wall lid may be utilized to access the liner box 17 for the withdrawal of replacement liners therefrom and through the divider wall lid.

The present invention comprises a refuse receptacle having an integrated bag storage compartment within its interior, wherein the storage compartment is located along the base of the can and is securely separated from the receptacle open interior. A sealed lid covers the storage compartment, wherein unused replacement liners may be stored without fear of contamination or exposure to waste prior to their deployment. When a filled bag is removed, the user reaches into the receptacle interior, removes the divider lid and retrieves a new liner. Once all of the liners are used, they can be refilled using a liner bag box through the internal divider lid or through the optional side access hatch. A variety of different trash cans having integrated bag storage compartments are disclosed in the prior art; however these devices fail to disclose a sealable interior cavity for the purposes of concealing and protecting unused replacement liners. The prior art generally comprises an aperture or slit along a false bottom of the receptacle, such that when one bag is removed the next bag is automatically dispensed; therefore, the storage compartments are not completely sealed from the trash can interior and thus are exposed to spilled or leaking refuse Associated with the present receptacle device is a method of manufacture, wherein the method of manufacturing the preferred embodiment of the present invention is further disclosed. The method comprises forming a receptacle structure having sidewalls, and open upper and closed lower portion. The receptacle further includes an inward ledge that defines a shelf upon which a divider wall is to be installed. The divider wall engages the shelf using a snap securement and adhesive to permanently bond the divider to the interior portion of the receptacle, therefore separating the receptacle interior into an open upper portion adapted to accept a receptacle liner and refuse, along with a lower, sealed cavity adapted to receive replacement liners. The adhesive is an optional step that permanently affixes the divider wall to the inward ledge, wherein a line, bead or quantity of applied adhesive bonding material is placed between the periphery of the divider wall and the receptacle inner ledge. If desired, the adhesive step may be skipped during construction such that divider is removable for access and cleaning purposes. A hingeable lid covers an aperture along the divider wall to provide a user with access into the lower cavity for retrieving replacement liners, wherein the lid is sealable and releasable on-demand, and creates a liquid-tight seal when closed. This seal prevents liquid and solid waste from spilling into the lower cavity and contaminating the replacement liners therein.

In light of the present disclosure and aforementioned prior art devices, it is submitted that the instant invention provides a unique and new receptacle container that advances the known elements in the prior art. It is not desired to limit the present invention to a single geometric shape or design, but rather to disclose a combination of elements that form the spirit of the invention. The shape, size and construction of the present receptacle may take several forms, while the interior cavity and sealed nature thereof is carried through each embodiment. It is further submitted that the device has been herein shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A waste receptacle, comprising:

a structure having upstanding sidewalls and a base forming an interior volume;

an internal divider wall extending substantially across the interior of said structure and separating said interior volume into an interior cavity and a receptacle upper portion;

said divider wall having an aperture providing access across to said interior cavity from said receptacle upper portion, said aperture being sealable in a water-tight fashion by a removable lid comprising a singular structure over said aperture, wherein said removable lid prevents liquid and solid material from entering said cavity from said receptacle upper portion;

said receptacle sidewalls further comprising an inward ledge having an interior edge within said interior volume, said interior edge having an upstanding portion extending upward therefrom;

said internal divider wall having a peripheral lip comprising an inverted u-shaped channel disposed along an outer edge and adapted to mate with said upstanding portion when in use.

2. The device of claim 1, wherein said peripheral lip is permanently attached to said receptacle inward ledge via a line of adhesive.

3. The device of claim 1, wherein said lid is hingeable from said divider wall.

4. The device of claim 1, wherein said removable lid further comprises a recessed finger hold comprising a water-tight depression in said removable lid for gripping and removing said lid from said divider wall while maintaining a water-tight seal.

5. The device of claim 1, wherein said removable lid further comprises an outward finger tab for gripping and removing said lid from said divider wall.

6. The device of claim 1, wherein said structure further comprises an access panel side door along said sidewall that provides access to said interior cavity through said structure sidewall.

7. The device of claim 6, wherein said access panel side door comprises a removable panel that is removable to reveal an aperture through said sidewall.

8. The device of claim 1, wherein said divider wall lid is sufficiently enlarged and extends along a majority of said divider wall surface to provide access for larger items into said cavity.

9. The device of claim 1, wherein said interior cavity is adapted to store replacement liners for said receptacle upper portion.

10. The device of claim 6, wherein said access panel side door comprises a hingeable panel that is removable to reveal an aperture through said sidewall.

11. The device of claim 1, wherein said removable lid is entirely detachable from said aperture when not in use.

12. The device of claim 1, wherein said internal divider is reinforced by one or more ribs disposed on a bottom surface of said internal divider.

13. A waste receptacle, comprising:

a structure having upstanding sidewalls and a base forming an interior volume;

an internal divider wall extending substantially across the interior of said structure and separating said interior volume into an interior cavity and a receptacle upper portion;

said divider wall having an aperture providing access across to said interior cavity from said receptacle upper portion, said aperture being liquid sealable by a removable lid comprising a singular structure over said aperture, wherein said removable lid provides a sealed boundary when secured over said aperture that prevents liquid and solid material from entering said cavity from said receptacle upper portion;

said receptacle sidewalls further comprising an inward ledge having an interior edge within said interior volume, said interior edge having an upstanding portion extending upward therefrom;

said internal divider wall having a peripheral lip comprising an inverted u-shaped channel disposed along an outer edge and adapted to mate with said upstanding portion when in use.

14. The device of claim 13, wherein said peripheral lip is permanently attached to said receptacle inward ledge via a line of adhesive.

15. The device of claim 13, wherein said lid is hingeable from said divider wall.

16. The device of claim 13, wherein said removable lid further comprises a recessed finger hold comprising a water-tight depression in said removable lid for gripping and removing said lid from said divider wall while maintaining a water-tight seal.

17. The device of claim 13, wherein said removable lid further comprises an outward finger tab for gripping and removing said lid from said divider wall.

18. The device of claim 13, wherein said structure further comprises an access panel side door along said sidewall that provides access to said interior cavity through said structure sidewall.

19. The device of claim 18, wherein said access panel side door comprises a removable panel that is removable to reveal an aperture through said sidewall.

20. The device of claim 13, wherein said divider wall lid is sufficiently enlarged and extends along a majority of said divider wall surface to provide access for larger items into said cavity.

21. The device of claim 13, wherein said interior cavity is adapted to store replacement liners for said receptacle upper portion.

22. The device of claim 18, wherein said access panel side door comprises a hingeable panel that is removable to reveal an aperture through said sidewall.

23. The device of claim 13, wherein said removable lid is entirely detachable from said aperture when not in use.

24. The device of claim 13, wherein said internal divider is reinforced by one or more ribs disposed on a bottom surface of said internal divider.

* * * * *